US009677336B2

(12) United States Patent
Najey

(10) Patent No.: US 9,677,336 B2
(45) Date of Patent: Jun. 13, 2017

(54) REMOVABLE LADDER STEP DEVICE

(71) Applicant: Abid Ali Najey, Brossard (CA)

(72) Inventor: Abid Ali Najey, Brossard (CA)

( * ) Notice: Subject to any disclaimer, the term of this patent is extended or adjusted under 35 U.S.C. 154(b) by 0 days.

(21) Appl. No.: 15/161,692

(22) Filed: May 23, 2016

(65) Prior Publication Data

US 2016/0376844 A1 Dec. 29, 2016

(51) Int. Cl.
*E06C 7/00* (2006.01)
*E06C 7/16* (2006.01)

(52) U.S. Cl.
CPC ..... *E06C 7/165* (2013.01)

(58) Field of Classification Search
CPC ..... E06C 7/165
See application file for complete search history.

(56) References Cited

U.S. PATENT DOCUMENTS 2,772,927 A * 12/1956 Woodward ..... E06C 7/16 182/121
3,294,197 A * 12/1966 Kwiatkowski ..... E06C 7/16 182/120
3,375,899 A * 4/1968 George ..... E06C 7/16 182/122
5,779,208 A * 7/1998 McGraw ..... E06C 7/165 182/120
6,148,958 A * 11/2000 Ahl ..... E06C 7/14 182/121
7,077,238 B2 * 7/2006 Butler ..... E06C 7/14 182/121
8,657,070 B2 * 2/2014 O'Brien ..... E06C 7/165 182/120
2014/0326538 A1 * 11/2014 Najey ..... E06C 7/08 182/129

* cited by examiner

*Primary Examiner* — Alvin Chin-Shue
(74) *Attorney, Agent, or Firm* — Benoit & Cote Inc; Marc Benoit

(57) ABSTRACT

A removable ladder step for providing a load support mountable to rung-ladders that have various rung cross-sections and/or various side rail depths. The removable ladder step has a load-supporting structure and a pair of adjustable holding devices connected thereto. The load-supporting structure has an upper wall connected to a front wall and to a rung-engaging wall. The upper wall configured to support a load thereon. A base member in a form of an elongated body is connected to the front wall and to the rung-engaging wall. An engaging space is formed in the rung-engaging wall for receiving and engaging a rung. Each of the adjustable holding devices has a holding member and a rail spacer connected thereto. The rail spacer is used to control a distance between a side rail and the holding member to accommodate ladders having various side rail depths.

15 Claims, 3 Drawing Sheets

REMOVABLE LADDER STEP DEVICE

BACKGROUND OF THE INVENTION

I. Field of the Invention

The invention pertains to rung-ladder attachments. More specifically, the invention pertains to a removable ladder step can be mounted on a rung-ladder for providing additional foot support. The device can also be used as a surface for holding tools or the like.

This invention is mainly intended for professionals spend extended period of time on a rung-ladder. This device improves work conditions and allows a user to save time and energy while standing on a ladder. Different techniques and materials were used to develop various ladder steps for providing an additional supporting area. The previous inventions are inconvenient, complex, unstable, heavy, costly or limited to be used with particular rung-ladders.

A ladder step should be wide enough to support a user's feet, stable, rigid, safe, capable of accommodating various leaning angles and/or various ladder types, readily mountable on a ladder, light in weight, relatively small in size for easy handling and positioning.

II. Description of the Prior Art

U.S. Pat. No. 8,657,070 to Richard O'Brien, Holly O'Brien, discloses a unitary step extension device comprising a standing surface extending between two (2) and three (3) inches and defining a pair of laterally opposed notches, a lip having at least one resilient stopper adapted to engage a rung, and a tube-shaped support having an engaging portion which engages two side rails. The lip of the unitary step is capable only of engaging a D-shaped rung because, mounting the unitary step on a round-shaped rung increases a moment arm which augments stresses in the lip and reduces strength. The removable ladder step of the present invention has neither lip nor notches, the present invention has a unique inclined rung-engaging wall extends from a base member to engage a rung, this has an advantage that the inclined rung-engaging wall acts in a direction that prevents a moment generation. This means that the rung-engaging wall resists only a tensile force which requires much lower strength in comparison to a moment action, as a result, the step of the present invention is capable of efficiently supporting a heavy load and engaging various rung types without affecting the strength or endangering safety. When installing the unitary step on a ladder, the lip engages the rung and the tube-shaped support engages the two side rails, the unitary step has no adjustment means for accommodating various side rail depths. The present invention has a unique pair of adjustable holding devices used to accommodate side rails having various depths. The tube-shaped support of the unitary step extends laterally beyond the standing surface to brace against the side rails, this feature makes the unitary step usable only with ladders that have a distance between a rear surface of a rung and a front face of a side rail equals to a distance between an interior surface of the lip and the engaging portion, this means that the unitary step can be only installed on certain types and/or sizes of ladders. In the present invention, a load-supporting structure is configured to be installed between two side rails so that the removable ladder step can be adjusted by the pair of adjustable holding devices. A horizontal standing surface, this feature is unachievable in the unitary step if the ladder includes side rails having a relatively small depth which creates a gap between the side rails and the engaging portion, the gape prevents a face to face contact which is essential to maintain the standing surface in a horizontal level. In the present invention, each one of the pair of adjustable holding devices has a rail spacer configured to adjust a standing surface relative to a horizontal plane. The unitary step offers a relatively small standing surface width because, increasing the width increases stresses generated in the lip which could cause the lip to fail. The unique configuration of the load-supporting structure allows the present invention to offer a standing surface having more convenient width. Further, the base member configured to have a rigid structure located in a position that prevents stresses from being concentrated in certain areas, the advantage of the base member is to increase the load bearing capacity of the removable ladder step.

U.S. Pat. No. 6,966,406 to Edward Lee Nash, discloses a step platform can only be used with a hollow rung ladder having open ends. The step platform extends wider than the side rails. A supporting rod extends beyond the side rails. Increasing the length of the step platform generates higher bending moment in the supporting rod. The present invention provides a unique rigid configuration of a base member, a front wall and a rung-engaging wall.

CA patent 2,028,158 to Nowlan, comprises a vertical supporting member to secure the platform to a pair of rungs.

CA patent 1,176,610 to Stecklow combines a supporting platform with a telescopically adjustable stabilizer.

U.S. Pat. No. 4,482,030 to Lincourt is for a safety platform with L-shape hooks used for attachment to the upper and lower rungs.

U.S. Pat. No. 1,920,552 to Dollerhide discloses a detachable ladder step secured to two rungs of a ladder; U-shape hooks are used for securing the ladder step to the upper rung.

U.S. Pat. No. 3,511,338 to Chapman discloses a U-shape bracket used to secure the apparatus to a lower rung and steel hooks to secure the stand to an upper rung.

U.S. Pat. No. 2,500,559 to Miller is directed to a ladder platform wherein a base is pivotally secured to one rung, with swinging hook means are adjustable to various positions, by means of notched formations inside flanges of the platform.

U.S. Pat. No. 3,294,197 to Kwiatkowski discloses a perch for a ladder that sits upon one rung and has a cross member which engages vertical support arms.

U.S. Pat. No. 4,646,878 to Moyer discloses a portable ladder step mountable on two rungs.

U.S. Pat. No. 4,401,187 to Van Patten discloses a ladder platform accessory using resilient bracket arms in a hinged connection to the platform.

U.S. Pat. No. 4,211,307 to Ethridge discloses a removable step for a ladder which permits the shelf or platform to be pivoted inward and outward so as not to obstruct normal use.

U.S. Pat. No. 3,067,836 to Carnicelli is directed to an adjustable step for ladders utilizing two side members which contact the ladder rungs.

U.S. Pat. No. 2,297,883 to Glover, U.S. Pat. No. 2,282,133 to Horton, U.S. Pat. No. 4,687,075 to Skaggs and U.S. Pat. No. 1,725,723 to Silva are variations of the Carnicelli type of construction.

U.S. Pat. No. 1,216,214 to Connell is also analogous to the construction type of Carnicelli.

U.S. Pat. No. 4,909,351 to Johnson, discloses a platform attachment for a ladder with both a retracted and a working position.

Taking into consideration the above mentioned features, none of the previous inventions, whether taken singly or in combination, discloses or suggests the particular characteristics of the present invention as claimed.

A need exists, therefore, for a novel removable ladder step that is rigid, compacted, stable and economic. The present invention provides further advantages as described in the following summary.

SUMMARY OF THE INVENTION

The present invention is generally directed to a removable ladder step that fits rung-ladders having various rung cross-sections and/or various side rail depths, the removable ladder step provides a wide foot support in comparison to a rung support.

In accordance with an embodiment of the invention, a removable ladder step comprises a load-supporting structure defining at least one space therein, a pair of stiffeners for improving rigidity and a pair of adjustable holding devices each having a holding member and a rail spacer attached thereto. The load-supporting structure comprises an upper wall connected to a front wall and to a rung-engaging wall. The load-supporting structure further comprises a base member connected to the front wall and the rung-engaging wall. The base member extends longitudinally below the upper wall and is spaced apart therefrom. The base member is strategically located relative to the upper wall such that stresses generated in the load-supporting structure can be prevented from being concentrated in specific areas. At least one longitudinal-stiffener extends longitudinally into a space defined by the load-supporting structure such that the space being divided into smaller spaces. The upper wall includes a top surface having anti-slip treads. The base member and the holding members cooperatively engage a pair of side rails of a rung-ladder. The rung-engaging wall comprises a rung-engaging portion defining an engaging space configured for receiving a rung therein. The rung-engaging wall further comprises at least one locking tooth configured for limiting pivoting movement. The rung-engaging wall is configured to be inclined to eliminate or severally limit a moment action so that only a tensile force is applied to the rung-engaging wall, this has the advantage that the load bearing capacity of the load-supporting structure can be significantly increased. Each one of the rail spacers has an axial space and at least one surface which is arranged at a specific distance from the axial space. The rail spacer is configured to allow the removable ladder step to accommodate various side rail depths.

A primary objective of the present invention is to provide a removable ladder step having advantages not taught by the prior art.

Another objective is to provide a relatively wide, safe and stable removable ladder step configured to withstand a heavy load without being deformed or failed.

A further objective is to provide an adjustable removable ladder step capable of readily accommodating various side rail depths and/or various rung cross-sections and/or various ladder angles of lean.

The removable ladder step is configured to be readily installed on a conventional rung-ladder. The load-supporting structure is mounted on a ladder's rung between two side rails such that the rung-engaging wall engages the rung, and the rail spacers abut the side rails.

Other features, objects and advantages of the present invention will become apparent from the following more detailed description, taken in conjunction with the accompanying drawings, which illustrate, by way of example, the principles of one or more embodiments of the present invention.

DETAILED DESCRIPTION OF EMBODIMENTS OF THE INVENTION

The following detailed description of the invention references the above-described drawing figures illustrates embodiments in which the invention may be practiced.

Although the invention will be essentially described in association with a rung-ladder having round cross-section rungs, it should be understood that the removable ladder step can be used with other rung types.

Figure 1:
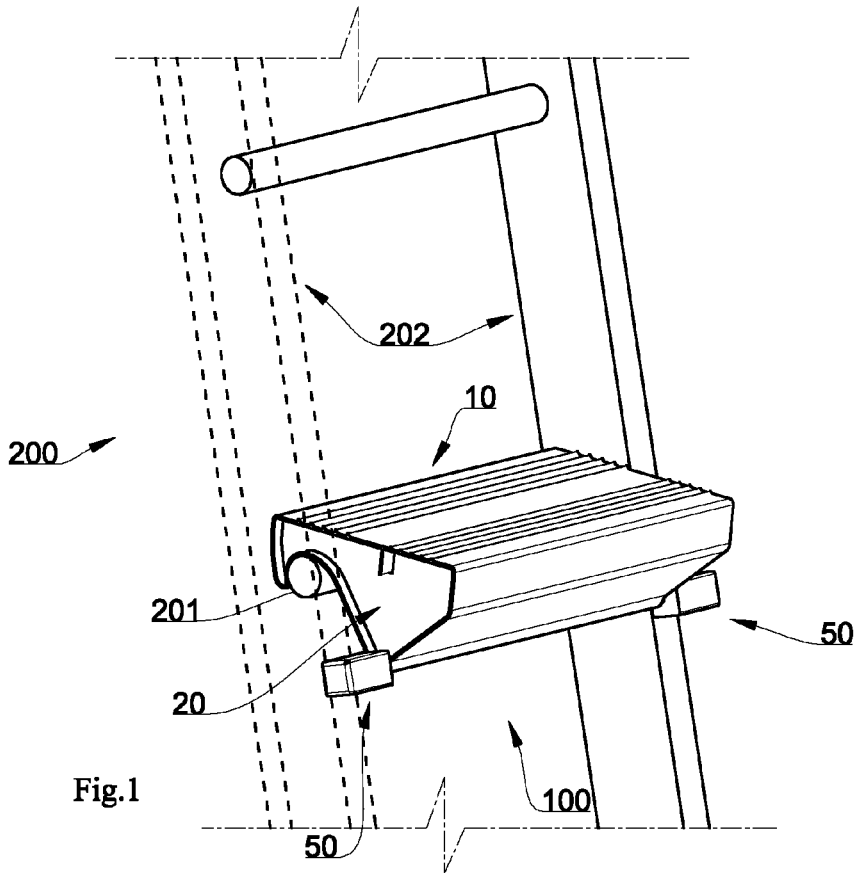
FIG. 1 is a top perspective view of a removable ladder step mounted to a rung-ladder leaning against support in accordance with an embodiment of the present invention.
Figure 2:
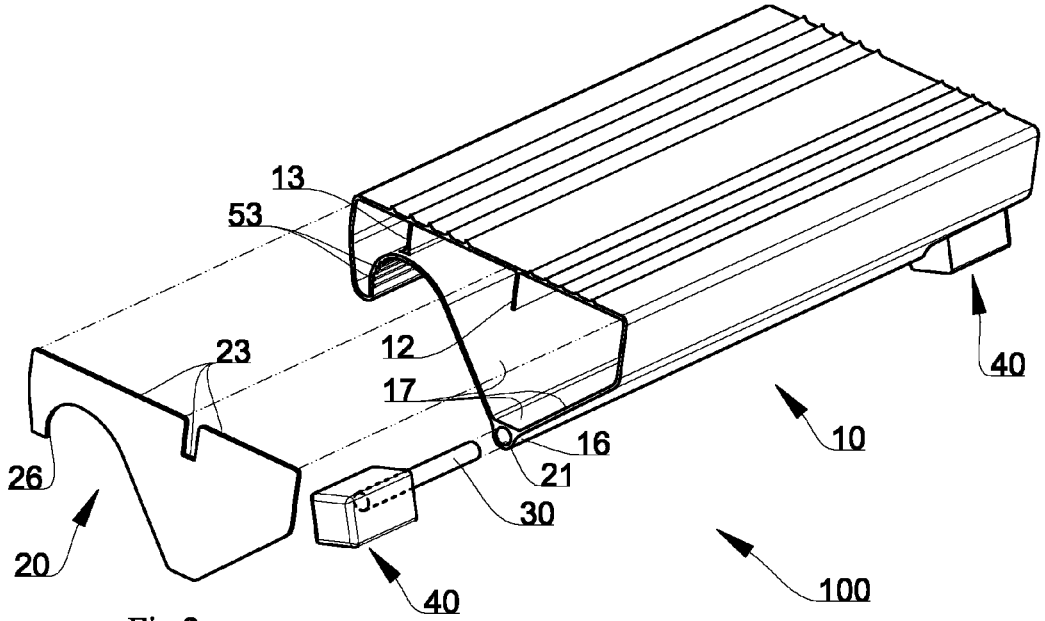
FIG. 2 is a partially exploded perspective view of a removable ladder step in accordance with an embodiment of the present invention.

With reference to FIGS. 1 and 2, a removable ladder step 100 is illustrated and generally designated by the numeral 100. The removable ladder step 100 mainly comprises a load-supporting structure 10 configured to provide a rigid support capable of supporting a load applied thereon, a pair of stiffeners 20, and a pair of adjustable holding devices 50 each having a holding member 30 and a rail spacer 40 pivotally attached thereto. A typical rung-ladder 200 is illustrated in a conventional slanted position that a rung-ladder would assume when positioned against a supporting wall, the rung-ladder 200 includes a series of rungs 201 and two opposing side rails 202.

FIG. 1 shows the removable ladder step 100 being mounted on a rung 201 and side rails 202. The load-supporting structure 10 is positioned between the side rails 202 and mounted on the rung 201, load-supporting structure 10 is configured to support a load generated by a user's weight. The pair of stiffeners 20 is configured for providing superior rigidity. A pair of holding members 30 is configured to engage the two side rails 202. A pair of rail spacers 40 is configured for accommodating rung-ladders having various side rail depths.

Removable ladder step 100 is generally constructed of metal, molded or extruded aluminum, plastic, composite, carbon fiber, wood, ceramic, any other suitable material known in the art, or a combination thereof. The material used may be selected based on manufacturer or user specific requirements such as manufacturing efficiency, strength, durability, appearance, or environmental considerations. Further, removable ladder step 100 can be manufactured using any suitable manufacturing method knowing in the art for the material including, but not limited to, casting, machining, forging, deep drawing, punching, molding press brake forming, die forming, extruding, stamping and/or joining. If required by the manufacturing method, coupling of components of removable ladder step 100 may be accomplished using any coupling means known in the art including, but not limited to, welds, screws, rivets, power actuated fasteners, pneumatic fasteners, bolts, nails, or adhesives.

Figure 6:
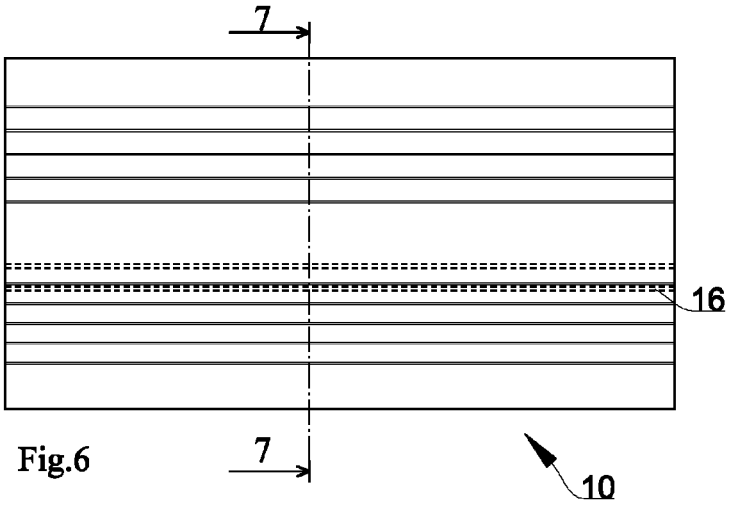
FIG. 6 is a plan view of a load-supporting structure showing the location of cross section 7-7, in accordance with an embodiment of the present invention.
Figure 7:
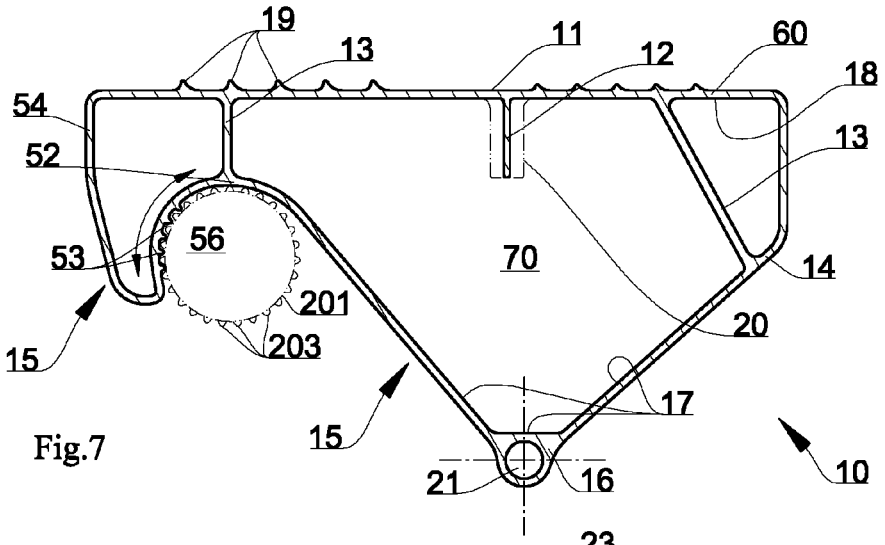
FIG. 7 is an enlarged cross-sectional view taken at line 7-7 of FIG. 6.

With reference to FIGS. 6 and 7, in an embodiment, the load-supporting structure 10 comprises an upper wall 60 having a front end, a rear end and a top surface 11 which extends in an imaginary plane, a front wall 14, a rung-engaging wall 15, a base member 16, at least one longitudinal-stiffener 13 and at least one rib 12 configured for improving rigidity. The top surface 11 has an anti-slip treads 19 for increasing friction between the top surface 11 and a surface of a sole. The top surface 11 is configured to provide a relatively large surface necessary to reduce stresses in user's feet while standing on a rung-ladder. The base member 16 defines an elongated body extending longitudinally below the upper wall 60 and spaced apart therefrom. The base member 16 has a receiving space 21 extending longitudinally thereinto. The base member 16 is located below the upper wall 60 in a strategic location such that stresses generated in the load-supporting structure 10 can be prevented from being concentrated in specific areas. This results in a significant improvement in the load bearing capacity of the load-supporting structure 10. The base member 16 is positioned relative to the upper wall 60 such that the imaginary plane of the top surface 11 can be brought in an angle close to an angle of a horizontal plane when the pair of rail spacers 40 abuts the side rails 202 and the rung-ladder 200 being leaned in a conventional angle against a support. The base member 16 is configured to receive at least part of each holding member 30.

In an embodiment, the base member 16 may have one or more receiving spaces 21 extending longitudinally thereinto. In another embodiment, the base member 16 has opposing ends extending laterally away from opposing lateral ends of the load-supporting structure 10.

In the embodiment of FIGS. 6 and 7, the front wall 14 connects the front end of the upper wall 60 to the base member 16. The rung-engaging wall 15 extends upwardly and rearwardly substantially from the base member 16, and has an end extends parallel to a longitudinal axis of the base member 16, and an opposing end of the rung-engaging wall 15 is connected to the upper wall 60 substantially at the rear end. The rung-engaging wall 15 is configured to be inclined to eliminate or severely limit a moment action so that only a tensile force needs to be resisted by the rung-engaging wall 15. The tensile force generates much lower stress in comparison to a stress generated by a moment, this has the advantage that a load bearing capacity of load-supporting structure 10 can be significantly increased. The rung-engaging wall 15 comprises a rung-engaging portion 52 extending longitudinally below the upper wall 60 and defining an engaging space 56 adapted for receiving and engaging the rung 201. The front wall 14, the rung-engaging wall 15, and the upper wall 60 together define a space 70 which extends longitudinally along the load-supporting structure 10.

In a preferred embodiment, the front wall 14, the rung-engaging wall 15, and the upper wall 60 together define one or more spaces 70.

In the embodiment of FIGS. 6 and 7, the front wall 14 is configured to support upper wall 60 and to transfer part of the applied load to the base member 16, the rung-engaging wall 15 is configured to support the upper wall 60, engage the rung 201 and to strengthen the base member 16. Each longitudinal-stiffener 13 extends longitudinally into the space 70 such that the space 70 being divided into smaller spaces to improve rigidity. Each rib 12 projects into the space 70 and extends longitudinally therein.

In a preferred embodiment, the at least one longitudinal-stiffener 13 and/or at least one rib 12 may be omitted when the load-supporting structure 10 made of a material having sufficient strength for supporting a user's weight without being deformed.

In the embodiment of FIGS. 6 and 7, a configuration includes the base member 16, the front wall 14 and the rung-engaging wall 15 is configured to support the load applied on the top surface 11, and to transfer part of the load to the side rails 202 in cooperation with the holding members 30.

In a preferred embodiment, the rung-engaging wall 15 has at least one locking tooth 53 extending longitudinally therealong. For safety purposes, a surface of a conventional rung usually having a non-slip feature 203 for gripping a shoe surface, the at least one locking tooth 53 is configured to engage the non-slip feature 203 and/or the rung surface so that a backward or forward pivoting movement about rung 201 can be limited. In another preferred embodiment, the rung-engaging wall 15 further comprises a bend 55 configured to provide an adequate space for engaging a rung having a D-shaped cross section, as best shown in FIG. 4.

Figure 4:
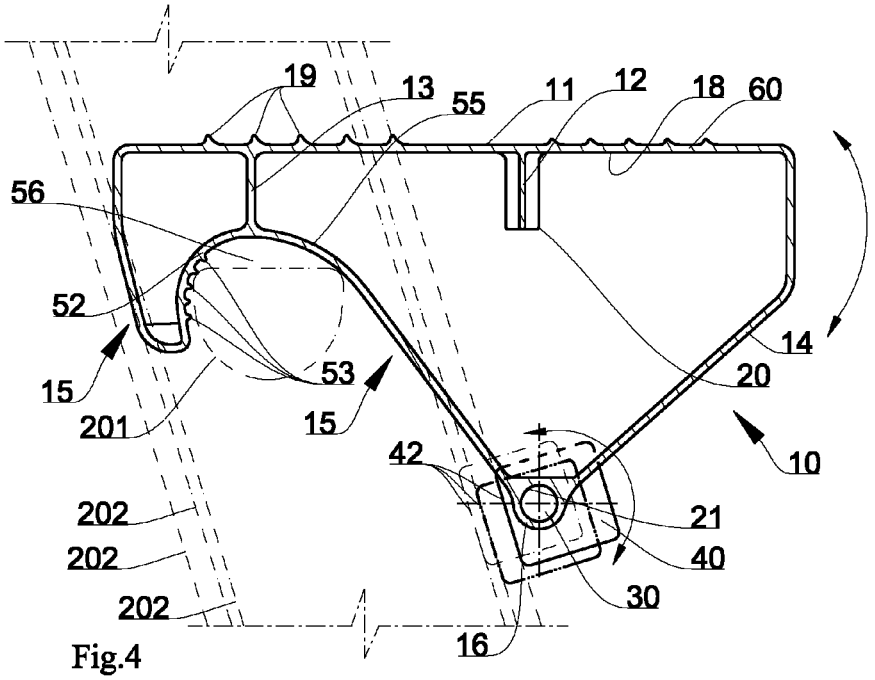
FIG. 4 is an enlarged cross-sectional view taken at line 4-4 of FIG. 3.
Figure 5:
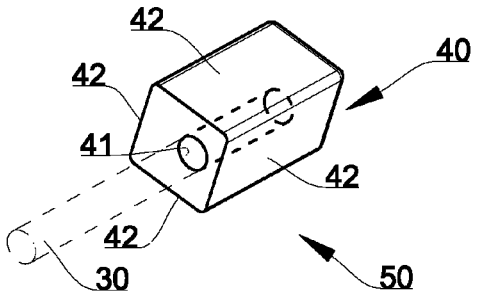
FIG. 5 is an enlarged perspective view of a rail spacer in accordance with an embodiment of the present invention.

Referring to FIG. 5, each rail spacer 40 is a generally elongated body having an axial space 41 extending longitudinally therein, and at least one surface 42. The axial space 41 is configured to receive at least a part of the holding member 30. To provide more than one level of adjustment, each of the at least one surface 42 is arranged at a specific radial distance from the axial space 41. As shown in FIG. 4, when a certain pair of surfaces 42 abuts the side rails 202, the load-supporting structure 10 is urged to pivot with a certain angle about the rung 201. The pair of rail spacers 40 is configured so that the removable ladder step 100 accommodates various side rail depths and/or ladder's angles of lean. A deviation angle of the imaginary plane from a horizontal plane can be adjusted by abutting side rails 202 by an appropriate pair of surfaces selected from surfaces 42 such that the deviation angle can be minimized or eliminated. In one embodiment, the rail spacer 40 may be fixedly attached to the holding member 30. In an exemplary embodiment, the pair of rail spacers 40 may be omitted.

When a user stands on the removable ladder step 100 his weight generates a downward force applied on the upper wall 60 pushes the load-supporting structure 10 downward. As the rung-ladder 200 leans against a support, and the pair of rail spacers 40 abuts the side rails 202, a generated force pulls the load-supporting structure 10 forward away from a rung-ladder plane. The downward force is mainly resisted by both holding members 30 and base member 16. The pulling force is resisted by the rung-engaging wall 15 which is configured to afford the removable ladder step 100 excellent stability by engaging rung 201 and limiting a pivoting movement.

Figure 3:
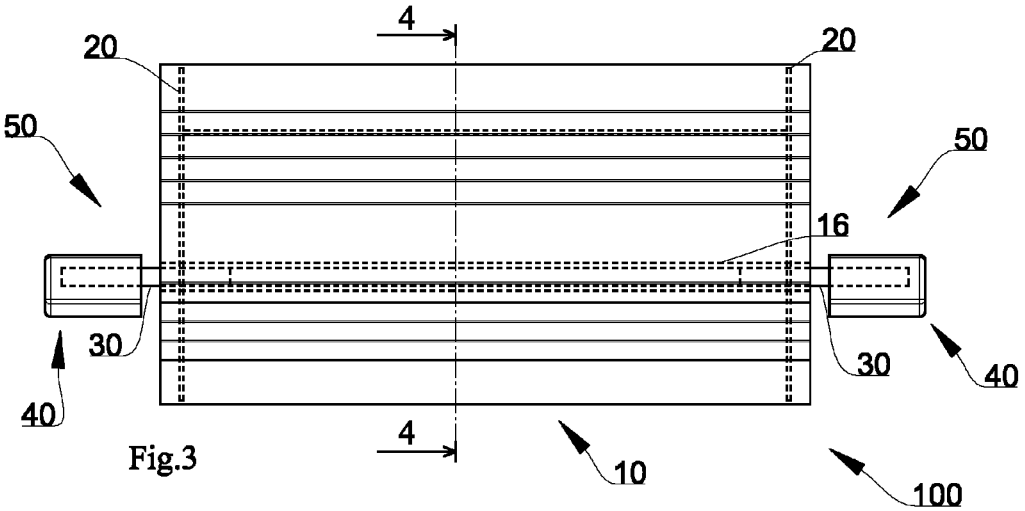
FIG. 3 is a plan view of a removable ladder step showing the location of cross section 4-4 in accordance with an embodiment of the present invention.

Referring to FIGS. 3 to 5, each of the pair of holding members 30 is shaped like an elongated body extending longitudinally. The pair of holding members 30 includes a first and a second holding member 30 being respectively connected to a first and a second lateral end of the load-supporting structure 10, each of the first and second holding members 30 has a first end and a second end opposite the first end, the first end extends laterally away from the load-supporting structure 10, the second end is received into the receiving space 21. In an embodiment, a first holding member 30 projects from the first lateral end and having an end extending laterally away from the load-supporting structure 10, a second holding member 30 projects from the second lateral end and having an end extending laterally away from the load-supporting structure 10. In another embodiment, a removable ladder step 100 may have a holding member 30 being received in the receiving space 21, the holding member 30 has two opposing ends respectively extending laterally away from the first and second lateral ends of the load-supporting structure 10, the two opposing ends are configured to engage the side rails 202.

Figure 8:
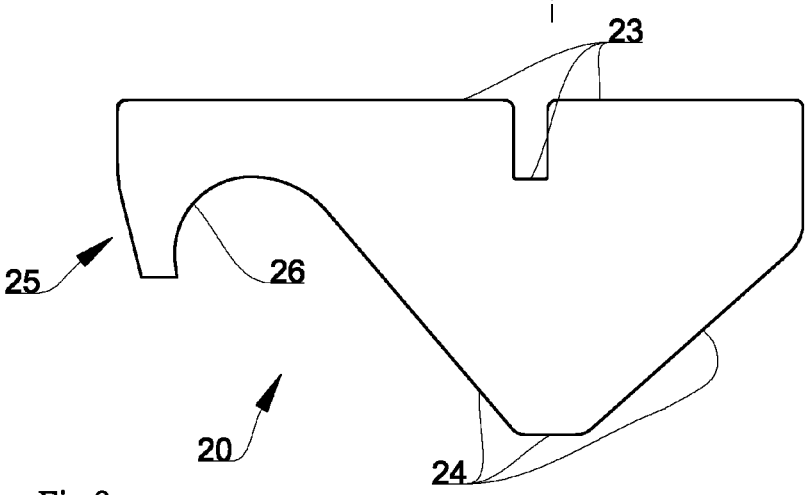
FIG. 8 is an enlarged front view of a stiffener in accordance with an embodiment of the present invention.

Referring to FIGS. 7 and 8, a stiffener 20 is preferably a flat plate. In an embodiment, at least one stiffener 20 is received in the space 70, each stiffener 20 comprises an upper side 23, a lower side 24 and a supporting-portion 25 having a surface 26. As best seen in FIG. 2, the supporting-portion 25 is configured to support the rung-engaging portion 52. The upper side 23 abuts the interior upper surface 18 and/or a lower end of the at least one rib 12. The lower side 24 is configured to abut at least part of an interior lower surface 17, as best seen in FIG. 7. The lower side 24 and the supporting-portion 25 are shaped in a manner such that surface 26 abuts the rung-engaging portion 52. The supporting-portion 25 is configured to strengthen the rung-engaging portion 52 so that flexing can be limited. In a preferred embodiment of the present invention, the at least one stiffener 20 may be omitted when the load-supporting structure 10 is made of a material having sufficient strength.

In operation, a user positions a rung-ladder in a conventional angle. Upon reaching a required level, the removable ladder step 100 is positioned between side rails 202 and then mounted on rung 201 in a manner such that the removable ladder step 100 can be brought into engagement with the rung 201 and the side rails 202 as shown in FIG. 1. To accommodate various side rail depths, a user has to use his own judgment and experience to select an appropriate pair of surfaces 42 to abut the side rails 202 so that a deviation angle from a horizontal plane can be minimized or eliminated.

Accordingly, while only a few embodiments of the invention have been described and illustrated, it will be apparent to those skilled in the art that various changes, additions or modifications may be made therein, without departing from the scope and spirit of the present invention as defined in the appended claims.

Having described the invention, I claim:

1. A removable ladder step for providing a load support mountable on a rung-ladder having a first side rail and a second side rail, the first and second side rails are connected together by a series of spaced apart rungs, said removable ladder step comprising:

a load-supporting structure configured to be mounted on a rung of said series of spaced apart rungs, wherein said load-supporting structure comprises:

an upper wall having a front end, a rear end and a top surface configured for allowing a load to rest thereon;

a front wall having an upper end connected to said upper wall substantially at said front end, the front wall further comprising a lower end;

a rung-engaging wall having an upper end connected to said upper wall substantially at said rear end, said rung-engaging wall comprising a rung-engaging portion extending longitudinally below said upper wall to define an engaging space configured for receiving the rung therein, the rung-engaging wall further comprising a lower end, wherein the rung-engaging wall is configured to be received, from the upper end thereof to the lower end thereof, between the first side rail and the second side rail when said load-supporting structure is mounted on the rung; and a base member defining an elongated body extending longitudinally along an axis below said upper wall thereby defining a base member axis, said base member being integrally connected substantially to the lower end of said front wall and the lower end of said rung-engaging wall; and a first adjustable holding device and a second adjustable holding device respectively extending from the base member on opposite lateral sides of said load-supporting structure substantially along the base member axis, wherein the first adjustable holding device and the second adjustable holding device respectively comprise a first holding member and a second holding member, wherein said first and second holding members are configured to respectively engage the first and second side rails, and wherein said first and second holding members are configured to project laterally from said base member, wherein the first adjustable holding device and the second adjustable holding device respectively comprise a first rail spacer and a second rail spacer respectively abutting the first and second side rails, wherein said first rail spacer comprises an axial space for receiving at least a portion of said first holding member and further comprises at least one surface arranged in a radial distance from said axial space, said first rail spacer being pivotally attached to said first holding member and configured to adjust a distance between the first side rail and the first holding member, wherein said second rail spacer comprises an axial space for receiving at least a portion of said second holding member and further comprises at least one surface arranged in a radial distance from said axial space, said second rail spacer being pivotally attached to said second holding member and configured to adjust a distance between the second side rail and the second holding member.

2. The removable ladder step of claim 1, wherein said first and second holding members being received in at least one receiving space extending longitudinally into said base member.

3. The removable ladder step of claim 1, further comprising at least one stiffener received into said at least one space and having a supporting-portion abutting said rung-engaging portion.

4. The removable ladder step of claim 1, wherein said load-supporting structure further comprises at least one longitudinal-stiffener extending longitudinally into said at least one space such that said at least one space being divided.

5. The removable ladder step of claim 1, wherein said load-supporting structure further comprises at least one rib extending longitudinally into said at least one space.

6. The removable ladder step of claim 1, wherein said load-supporting structure being constructed of an extruded material.

7. The removable ladder step of claim 1, wherein said rung-engaging wall further comprises a bend configured for accommodating a rung having a D-shaped cross section.

8. The removable ladder step of claim 1, wherein said rung-engaging wall further comprises at least one locking tooth.

9. The removable ladder step of claim 1, wherein said top surface comprises anti-slip treads.

10. A removable ladder step for providing a load support mountable on a rung-ladder having a first side rail and a second side rail, the first and second side rails are connected together by a series of spaced apart rungs, said removable ladder step comprising a load-supporting structure configured to be mounted on a rung of said series of spaced apart rungs, wherein said load-supporting structure comprises:

a generally hollow body defining a space therein; and a base member integrally connected to said hollow body and extending longitudinally along an axis thereby defining a base member axis;

wherein said generally hollow body comprises:

an upper wall having a front end, a rear end and a top surface configured for allowing a load to rest thereon;

a front wall having an upper end connected to said upper wall substantially at said front end, the front wall further comprising a lower end;

a first adjustable holding device and a second adjustable holding device respectively extending from the base member on opposite lateral sides of said load-supporting structure substantially along the base member axis; and a rung-engaging wall extending upwardly and rearwardly substantially from said base member and below said upper wall, said rung-engaging wall being connected to said upper wall substantially at said rear end, wherein said rung-engaging wall comprises a rung-engaging portion extending longitudinally below said upper wall to define an engaging space configured for receiving the rung therein, the rung-engaging wall further comprising a lower end, wherein the rung-engaging wall is configured to be received, from the upper end thereof to the lower end thereof, between the first side rail and the second side rail when said load-supporting structure is mounted on the rung; and wherein said base member defines an elongated body extending longitudinally below said upper wall and spaced apart therefrom, said base member being integrally connected substantially to the lower end of said front wall and the lower end of said rung-engaging wall, wherein the first adjustable holding device and the second adjustable holding device respectively comprise a first holding member and a second holding member respectively located on opposite lateral sides of said load-supporting structure, wherein said first and second holding members are configured to respectively engage the first and second side rails, and wherein said first and second holding members are configured to project laterally from said base member, wherein the first adjustable holding device and the second adjustable holding device respectively comprise a first rail spacer and a second rail spacer respectively abutting the first and second side rails, wherein said first rail spacer comprises an axial space for receiving at least a portion of said first holding member and further comprises at least one surface arranged in a radial distance from said axial space, said first rail spacer being pivotally attached to said first holding member and configured to adjust a distance between the first side rail and the first holding member, wherein said second rail spacer comprises an axial space for receiving at least a portion of said second holding member and further comprises at least one surface arranged in a radial distance from said axial space, said second rail spacer being pivotally attached to said second holding member and configured to adjust a distance between the second side rail and the second holding member.

11. The removable ladder step of claim 10, wherein said first and second holding members being received in at least one receiving space extending longitudinally into said base member.

12. The removable ladder step of claim 10, further comprising at least one stiffener received into said space and having a supporting-portion abutting said rung-engaging portion.

13. The removable ladder step of claim 10, wherein said load-supporting structure further comprises at least one longitudinal-stiffener extending longitudinally into said space such that said space being divided.

14. The removable ladder step of claim 10, wherein said rung-engaging wall further comprises a bend for accommodating a rung having a D-shaped cross-section.

15. A removable ladder step for providing a load support mountable on a rung-ladder having a first side rail and a second side rail, the first and second side rails are connected together by a series of spaced apart rungs, said removable ladder step comprising:

a load-supporting structure configured to be mounted on a rung of said series of spaced apart rungs; and an adjustment system;

wherein said load-supporting structure comprises an upper wall, a front wall, a rung engaging member and a base member;

said upper wall having a top surface configured for allowing a load to rest thereon, wherein said upper wall is connected to said front wall and said rung engaging member;

wherein said rung engaging member defines a rung-engaging wall shaped to provide a rung-engaging portion defining an engaging space configured to receive and engage the rung therein;

wherein said base member defines an elongated body extending longitudinally along an axis below said upper wall thereby defining a base member axis and integrally connected to said front wall and to said rung-engaging wall; and wherein said adjustment system comprises a first adjustable holding device and a second adjustable holding device respectively located on opposite lateral sides of said load-supporting structure, and extending from the base member on said opposite lateral sides of said load supporting structure substantially along the base member axis wherein said first adjustable holding device comprises a first holding member projecting laterally from said base member, and a first rail spacer pivotally attached to said first holding member, said first rail spacer comprising at least one surface configured to abut the first side rail such that a distance between the first side rail and said first holding member can be adjusted upon pivoting of the first rail spacer, wherein said second adjustable holding device comprises a second holding member projecting laterally from said base member, and a second rail spacer pivotally attached to said second holding member, said second rail spacer comprising at least one surface configured to abut the second side rail such that a distance between the second side rail and said second holding member can be adjusted upon pivoting of the second rail spacer.

* * * * *